United States Patent [19]

Urbano

[11] Patent Number: 4,938,346

[45] Date of Patent: Jul. 3, 1990

[54] WALL MOUNTED SOAP DISH

[76] Inventor: Virgilio M. Urbano, 15 15th St., #17, Hermosa Beach, Calif. 90254

[21] Appl. No.: 408,201

[22] Filed: Sep. 18, 1989

[51] Int. Cl.[5] ..... A47K 5/08

[52] U.S. Cl. ..... 206/77.1

[58] Field of Search ..... 206/77.1

[56] References Cited

U.S. PATENT DOCUMENTS

| | | | |
|---|---|---|---|
| 2,356,056 | 8/1944 | Hogg | 206/77.1 |
| 2,399,533 | 4/1946 | Albright | 206/77.1 |
| 2,409,827 | 10/1946 | Blankner | 206/77.1 |
| 3,063,190 | 11/1962 | Adelson | 206/77.1 |
| 4,344,529 | 8/1982 | Ibarzabal | 206/77.1 |
| 4,611,716 | 9/1986 | Sorlien | 206/77.1 |

FOREIGN PATENT DOCUMENTS

| | | | |
|---|---|---|---|
| 293064 | 7/1965 | Netherlands | 206/77.1 |

*Primary Examiner*—Joseph Man-Fu Moy

*Attorney, Agent, or Firm*—Roger A. Marrs

[57] ABSTRACT

A soap dish is disclosed herein for holding a bar of soap having a hollow housing supported from a vertical surface by suction cups or the like. The housing is provided with a hinged lid opening into the interior which includes a plurality of raised ridges in fixed parallel spaced-apart relationship for supporting a bar of soap. A multiplicity of drain openings are formed in the bottom of the housing beneath the supported soap bar between adjacent ones of the ridges to conduct drainage water exteriorly of the housing.

1 Claim, 1 Drawing Sheet

WALL MOUNTED SOAP DISH

BACKGROUND OF THE INVENTION

1. Field of the Invention

The present invention relates to soap dishes and more particularly to a novel soap dish protecting soap from either lying in a pool of water or from shower spray which would normally strike the bar while in its stored location.

2. Brief Description of the Prior Art

In the past, it has been the conventional practice to provide a soap dish along the edge of a bathtub or sink for the purpose of supporting a bar of soap when not being used. Generally, such a soap dish outwardly projects from a walled surface or is carried on a flat portion of the bathtub or sink. The dish does not include a lid or cover so that when water is splashed or sprayed during a shower, impingement of the spray on the soap deteriorates and washes the soap away which is wasteful and inefficient. At times, the size of the bar is greatly reduced when the spray from a shower directly strikes the bar. Also, problems and difficulties have been encountered due to the fact that the soap dish collects water in its bottom and the stored soap is placed therein so that the bar melts or rapidly deteriorates in a pool of collected water.

Also, most wall-mounted soap dishes require the drilling of holes into the wall so that supporting screws can be installed for holding the dish in an outward cantilevered position. Such an installation requires skill where tile is involved and requires tools and the ability to use the tools for installation.

Therefore, a long standing need has existed to provide a novel soap dish having means for preventing the soap from lying in collected water and which will prevent impingement or striking of shower spray against the soap bar as it is supported in the dish. Such means should be economical and should also include a mounting means which does not require skill, special mounting fasteners or which will require marring or drilling into the supporting wall.

SUMMARY OF THE INVENTION

Accordingly, the above problems and difficulties are obviated by the present invention which provides a novel soap dish having a housing which includes a hinged lid or cover adapted to interfere with shower spray or the like while soap is stored within the storage compartment of the housing. Mounting means are employed which are integrally carried on the back of the housing, such as suction cups, that may readily engage with the supporting wall surface for releasably holding the housing in an outwardly projecting and cantilevered position. The bottom of the soap dish is curved so as to cause collected water to collect at the bottom of the housing and drain holes or apertures are provided through the bottom for drainage purposes. A plurality of raised ridges is placed about the drainage holes so that the soap will rest on top of the ridges permitting the soap to dry without resting or lying in collected water.

The lid may be hinged or in some instances, it is preferred that the lid be manually placed on top of the dish when the soap is intended to be stored.

Therefore, it is among the primary objects of the present invention, to provide a novel soap dish container which will prevent deterioration of a bar of soap from shower spray and water impingement upon the surface of the soap bar.

Another object of the present invention is to provide a novel means for storing soap so that it is conserved and is not resting in a pool of water or the like.

Another object of the present invention is to provide a novel soap dish container that may be readily attached to a wall surface without the necessity of installation and which provides support means for the soap so that it will drain and dry in a normal manner.

Yet another object of the present invention is to provide a novel soap dish container having a lid for protecting the soap held in a storage compartment in an elevated manner so that the soap may readily dry in a moisture-free environment.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
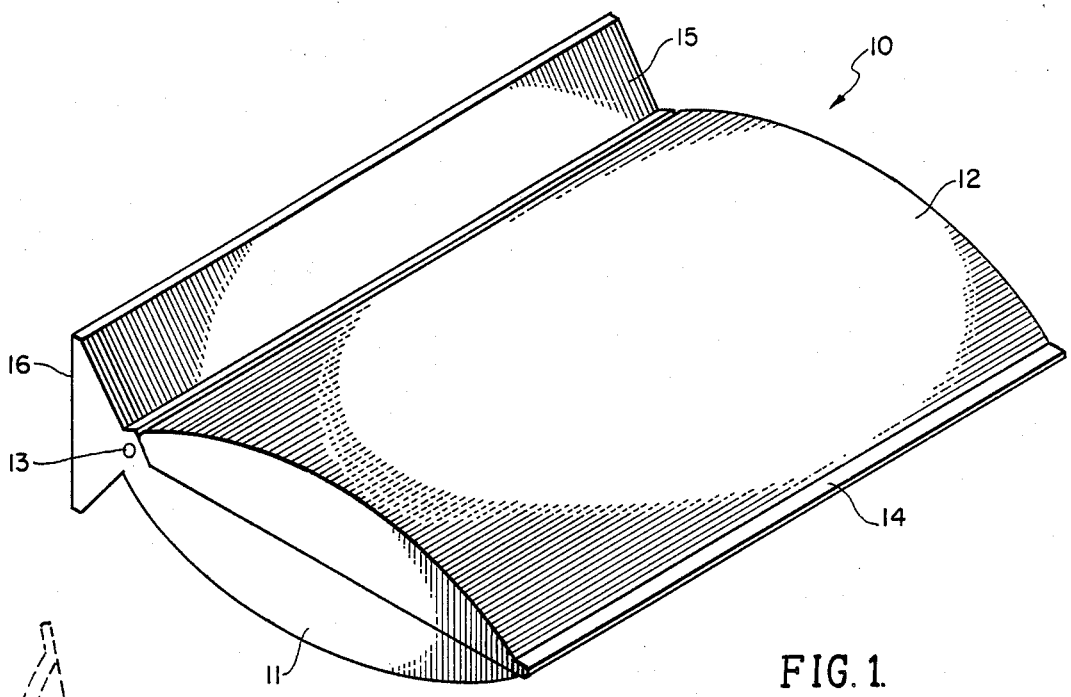
FIG. 1 is a front perspective view showing one version of the novel soap dish container incorporating the present invention.

Referring to FIG. 1, the novel soap dish of the present invention is illustrated in the general direction of arrow 10 which includes a soap dish 11 having a lid 12 which is hingeably connected to the dish 11 by means of molded post and hole combination indicated in general by numeral 13. The front end of the lid or cover 12 includes a lip 14 which may be readily grasped by the hand of the user for opening and closing the lid. At the rear of the dish is a mounting member 15 which includes a rear flat surface 16 that is adapted to bear against a vertical flat wall. The soap dish 10 illustrated in FIG. 1 is in its soap storage position so that it can be seen that any spray from the shower or bathing will not strike the soap since the lid 12 will block or interfere with such striking.

Figure 2:
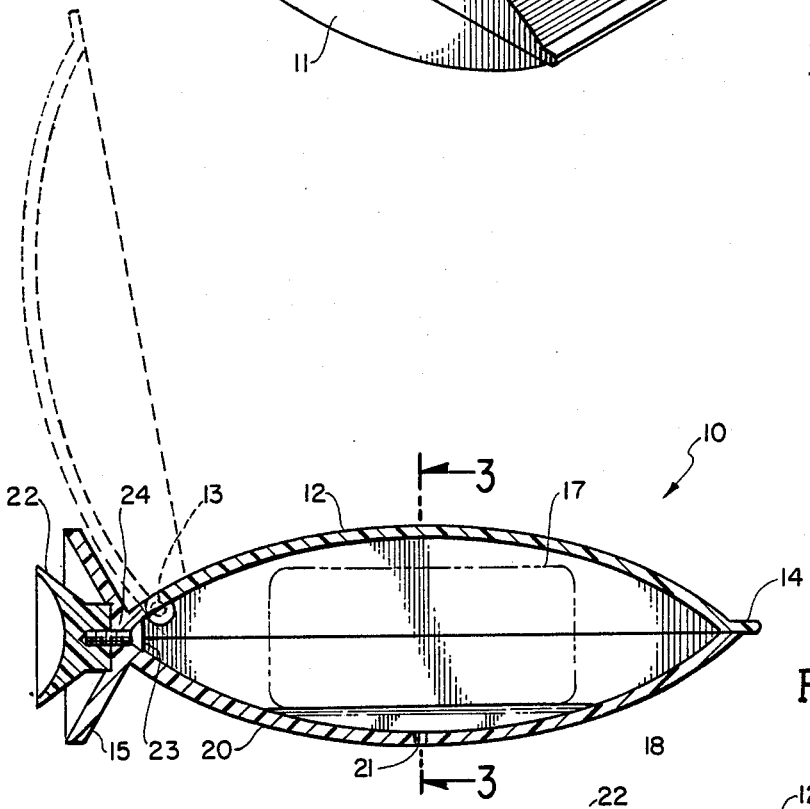
FIG. 2 is a transverse cross-sectional view of the soap container shown in FIG. 1.
Figure 3:
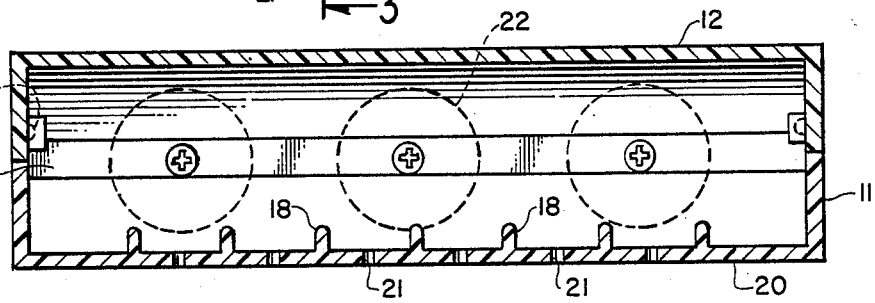
FIG. 3 is a longitudinal cross-sectional view of the soap container shown in FIG. 2 taken in the direction of arrows 3—3 thereof.

Referring now in detail to FIGS. 2 and 3, it can be seen that a bar of soap indicated by numeral 17 is resting on a plurality of parallel ridges 18 carried on a bottom 20 of the soap dish 10. Also, the bottom 20 is provided with a plurality of drain holes such as hole 21 so that water accumulation can pass out of the dish. The soap bar 17 is supported on the plurality of ridges 18 and does not rest in any water accumulation which may occur at the extreme bottom of the dish bottom 20.

FIGS. 2 and 3 more clearly illustrate the mounting means for detachably supporting the soap dish 10 onto a flat surface. One such means is a plurality of suction cups, such as suction cup 22, which are carried within the member 15 by such means as screws 23 or the like. The member 15 protects the fastening means, such as the suction cup 22, from contact with any water which may splash or strike against the dish 10. For mounting the suction cup means, the member 15 is provided with a thickened portion 24 which joins the member 15 with the back side of dish 10. The lid or cover 12 is pivotally attached to opposite flanges integrally formed on the opposite ends of the member's thickened portion 24.

Therefore, it can be seen that the novel soap dish of the present invention will properly hide and protect a quantity of soap from splashing or water striking against the soap during a bathing procedure. The lid 12 is hingeably carried on the dish 11 and may be closed in the solid-line position shown in FIGS. 1 and 2 to protect the soap. When opened, as shown in broken lines in FIG. 2, the user may have access to the soap during the bathing procedure. Any water which would enter the dish will be discharged through the drainage openings 21 that are disposed between adjacent ones of the ridges 18. Preferably, the ridges are arranged parallel to one another in fixed spaced-part relationship with the drainage holes 21 inbetween. The soap bar 17, as shown in FIG. 2, is supported on top of the ridges so that it will not come into contact with any pool or collection of water at the bottom of the dish. Furthermore, the external surface of the lid or cover 12, as well as the supporting member 15, includes an area on which advertising or message display information can be placed. Indicia may either be imprinted directly onto the surface of the lid 12 or member 15 or, if desired, suitable adhesive labels may be attached While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. In a soap dish for protecting a soap bar from direct impingement of shower or bathing spray comprising the combination of:

a soap dish having a bottom with upwardly projecting elongated and parallel ridges;

a soap bar supported on said ridges;

drainage holes provided in said dish between adjacent ones of said ridges;

mounting means carried on said dish for attachment to a vertical wall which includes an elongated stiffening and rigid member along the rear of said dish;

suction cup means supported in load-bearing relationship on said member having a flexible cup outwardly protruding from said member;

a cover movably carried on said dish selectively shielding contents of said dish from environmental spray or the like;

said dish bottom is concave and said cover is convex in transverse cross-section, said cover having an inner surface in spaced-apart relationship with respect to said soap bar so as to avoid pressure of said soap bar;

an elongated lip carried on said cover protruding beyond the edge of said dish;

hinge means pivotally connecting said cover to said dish for selective exposure of the interior of said dish; and said rigid member further having a V-shaped defined cavity substantially enclosing said suction cup mean presenting an exterior angled surface protecting said suection means from direct inpingement of shower spray.

* * * * *